United States Patent [19]

Svensson

[11] 4,043,744

[45] Aug. 23, 1977

[54] BASE OR STAND FOR A CAMPING STOVE

[75] Inventor: Karl Ernst Svensson, Eskilstuna, Sweden

[73] Assignee: Aktiebolaget Optimus, Sweden

[21] Appl. No.: 608,107

[22] Filed: Aug. 27, 1975

[30] Foreign Application Priority Data

Sept. 4, 1974 Sweden ..... 74111873

[51] Int. Cl.[2] ..... F23Q 2/00; F24C 5/20

[52] U.S. Cl. ..... 431/142; 126/38; 222/5; 220/293

[58] Field of Search ..... 431/142, 344; 126/38; 222/5; 220/293, 298, 300, 301; 339/88 R

[56] References Cited

U.S. PATENT DOCUMENTS

| | | | |
|---|---|---|---|
| 2,853,126 | 9/1958 | Corlet | 126/38 |
| 2,890,815 | 6/1959 | Corlet | 431/142 |
| 3,291,341 | 12/1966 | Simmons | 222/5 |
| 3,905,755 | 9/1975 | Aske | 222/5 |

FOREIGN PATENT DOCUMENTS

| | | | |
|---|---|---|---|
| 509,494 | 11/1920 | France | 339/88 R |
| 1,503,773 | 12/1967 | France | 220/293 |

*Primary Examiner*—Carlton R. Croyle
*Assistant Examiner*—Thomas I. Ross
*Attorney, Agent, or Firm*—Ostrolenk, Faber, Gerb & Soffen

[57] ABSTRACT

A camping stove having a housing for receiving an expendable gas container. The gas container is punctuated by a puncturing means at the upper inner end of the housing to connect the container with valve supporting the puncturing means. The valve means and the puncturing means are rotationally and stationarily mounted in the housing. The container is enclosed in the housing by a lid which supports a screw employed to press the container against the puncturing means without rotating the gas container.

5 Claims, 11 Drawing Figures

BASE OR STAND FOR A CAMPING STOVE

The present invention relates to such camping stoves which are run on gas from an expendable container fixed in a holder forming part of a stove, the container being punctured at its upper end for releasing the gas to a valve unit arranged at the upper end of the holder. On the valve unit there is a manually operable regulating valve for respectively closing and regulating the gas supply to a jet. The valve unit is also provided with a thread onto which different types of burner may be screwed. A cooking burner with a cooking utensil support is usually screwed onto the valve unit, but the cooking burner can be unscrewed and exchanged for a lamp, for example. A heating element can also be screwed onto the valve unit.

In a known camping stove the holder consists of a substantially cylindrical housing, into the upper end of which the valve unit is removably threaded, the valve unit having a puncturing means which is directed towards a gas container placed inside the housing. The bottom portion of the housing is removable, and at its edge it is formed with a ring fitting inside the housing and lockable to the latter by means of a bayonet coupling. When the valve unit is unscrewed, the gas container is placed inside the housing and is kept in place there by the bottom portion being assembled with the help of the bayonet coupling. In the edge ring of the bottom portion there are grooves for coaction with protrusions or keys on the inside of the housing. The bottom portion is pressed axially into the entry grooves of the bayonet coupling and is twisted in its twisting grooves to a bottoming position where the bottom portion is allowed to fall back somewhat in a portion of the groove, where return movement of the bottom portion is prevented if the bottom portion is not first pressed slightly inwards. In the bottoming position the bottom portion can thus move freely between two axial positions. The appropriate burner is then screwed on, whereat the puncturing means penetrates into the upper end of the gas container and releases gas to the valve unit. There is an elastic seal around the puncturing means.

In the known camping stove there are, however, certain risks. Inter alia, there is the risk that the valve unit can be unscrewed to a greater or lesser extent when the burner is changed. Gas can then leak out at the puncturing means. If the stove is still hot, there is the risk of fire.

Another risk with the known stove is that the bottom portion has a certain amount of inward movement in the housing due to the design of the bayonet coupling. If the bottom portion thus receives a heavy blow, e.g. if the stove is dropped and the bottom portion knocks against a solid object, the gas container is given a deformation which can cause the force against the elastic seal at the puncturing means to disappear, and leakage occurs with the risks mentioned above.

The object of the present invention is to eliminate the above-mentioned risks, and this is achieved by a camping stove which, according to the invention, has the distinguishing features given in the following claims. The camping stove according to the invention has a lower portion with a substantially cylindrical housing forming the stand for the stove. The bottom portion of the housing is formed by a cover or a corresponding supporting portion for a gas container inserted in the housing. In the center of the bottom supporting portion there is a screw with a thumbwheel or knob, and by screwing in the screw the latter will provide an axial displacement of the container and press it against a seal and a puncturing means at the upper end of the housing. The puncturing means is attached to the valve unit which is rigidly united with the housing so that it cannot be turned relative to the housing when exchanging burners. The inner end of the screw suitably carries a supporting or spreader plate rotatably mounted on the screw, fitted against the bottom of the gas container and distributing the comprissive force from the screw. The bottom portion is so united with the housing that the bottom portion cannot be pressed inwardly relative to the housing when it is in its position of retaining the gas container. Complete safety against such leakage, which can occur in the known camping stove, is thus achieved by the invention.

A suitable embodiment of a camping stove with the lower portion according to the invention is described in the following while referring to the attached drawings.

FIG. 1 is a side view of a camping stove with a burner and cooking utensil support.

FIGS. 1*a* and 1*b* are enlarged detailed views of a nodule in the cover of the bottom portion of a camp stove.

Figure 3:
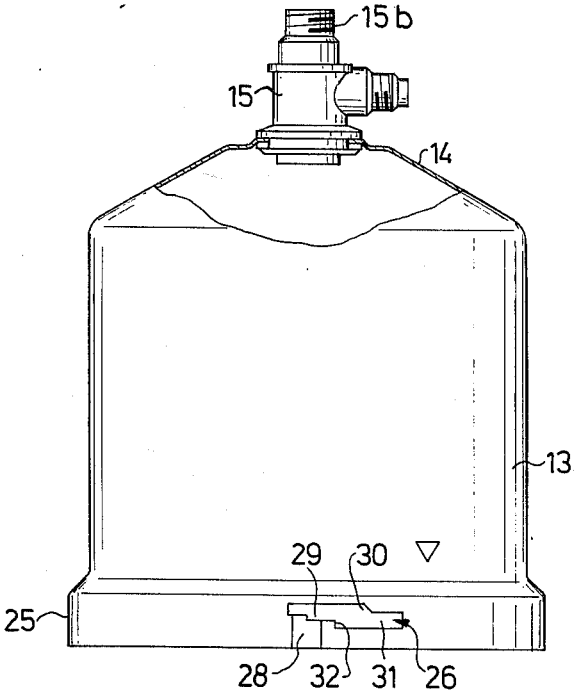
FIG. 3 is a partially sectioned side view of the lower portion housing.
Figure 3A:
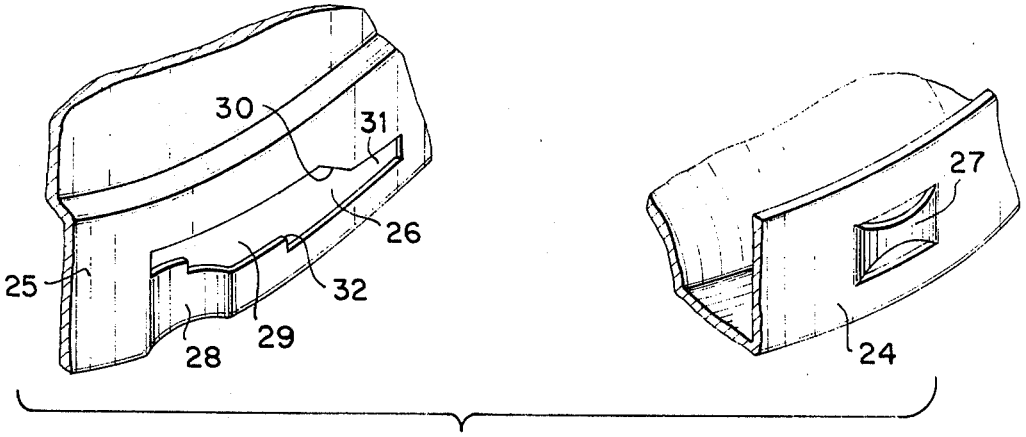

FIG. 3*a* is an enlarged detailed view of a bayonet coupling comprising part of the invention.

Figure 4:
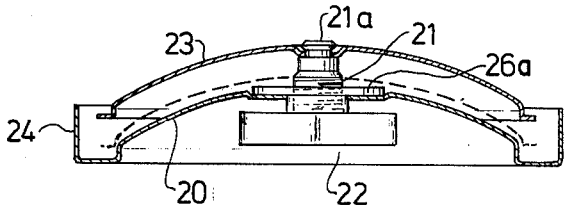

FIG. 4 is a cross section through the bottom portion made as a cover.

Figure 5:
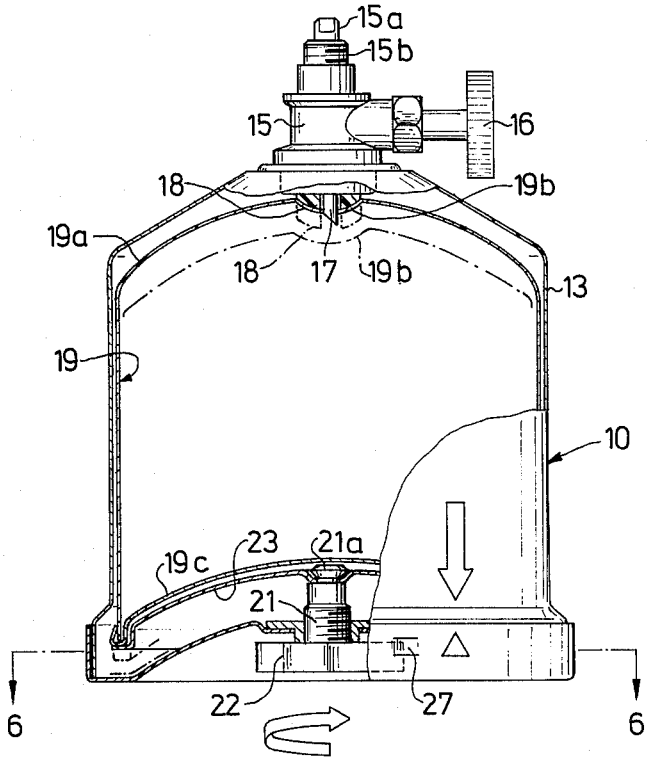

FIG. 5 is a section through the lower portion housing, an inserted gas container and the bottom portion, the screw in the bottom portion having been tightened so that the gas container has been axially displaced from the initial position shown by chain lines to the final position shown with full lines where the container is punctured.

Figure 6:
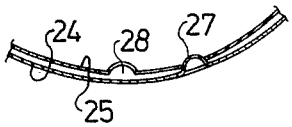

FIG. 6 is a section along the line 6—6 in FIG. 5.

Figure 7:
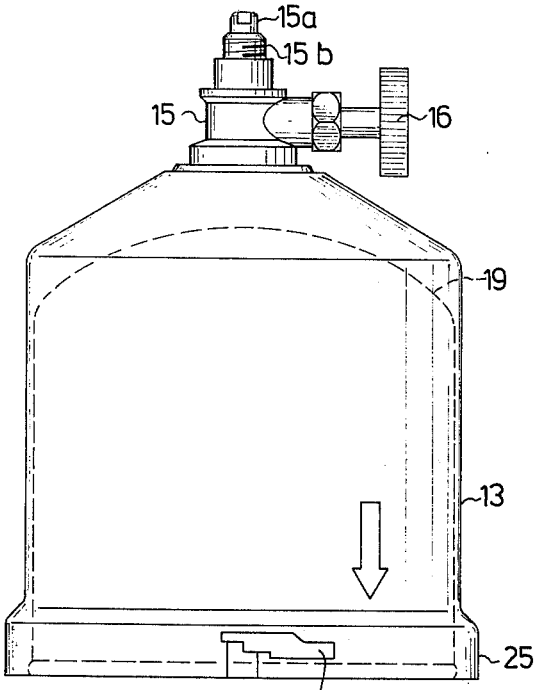

FIG. 7 is a side view of the lower portion housing, and

Figure 8:
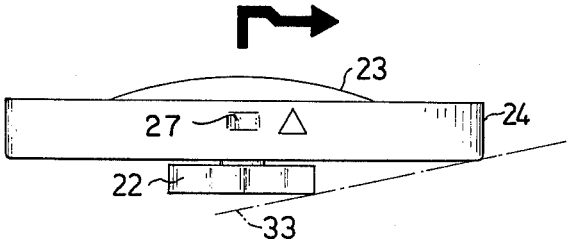

FIG. 8 shows the bottom portion with an arrow drawing above it indicating the displacing and twisting movements of the bottom portion when it is being coupled together with the lower portion housing.

Figure 1:
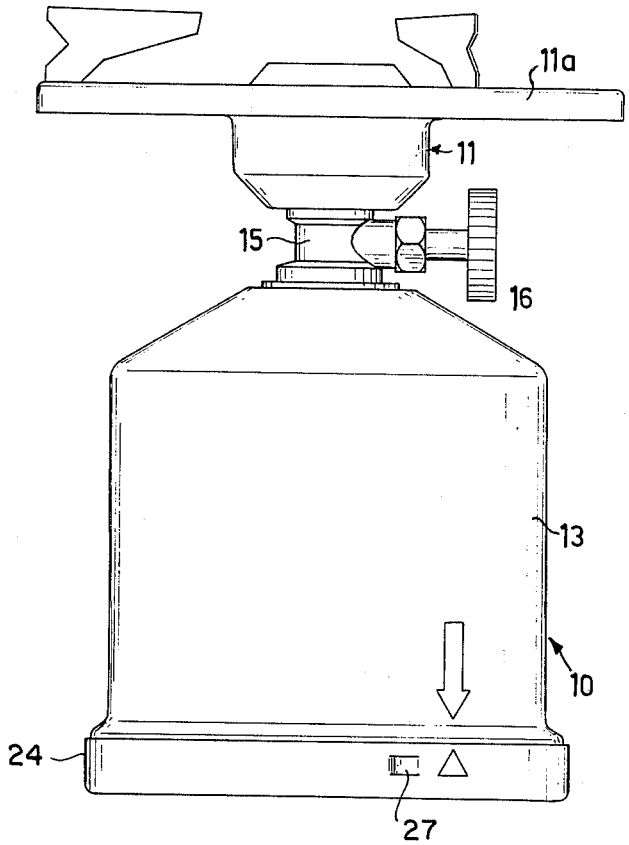
Figure 2:
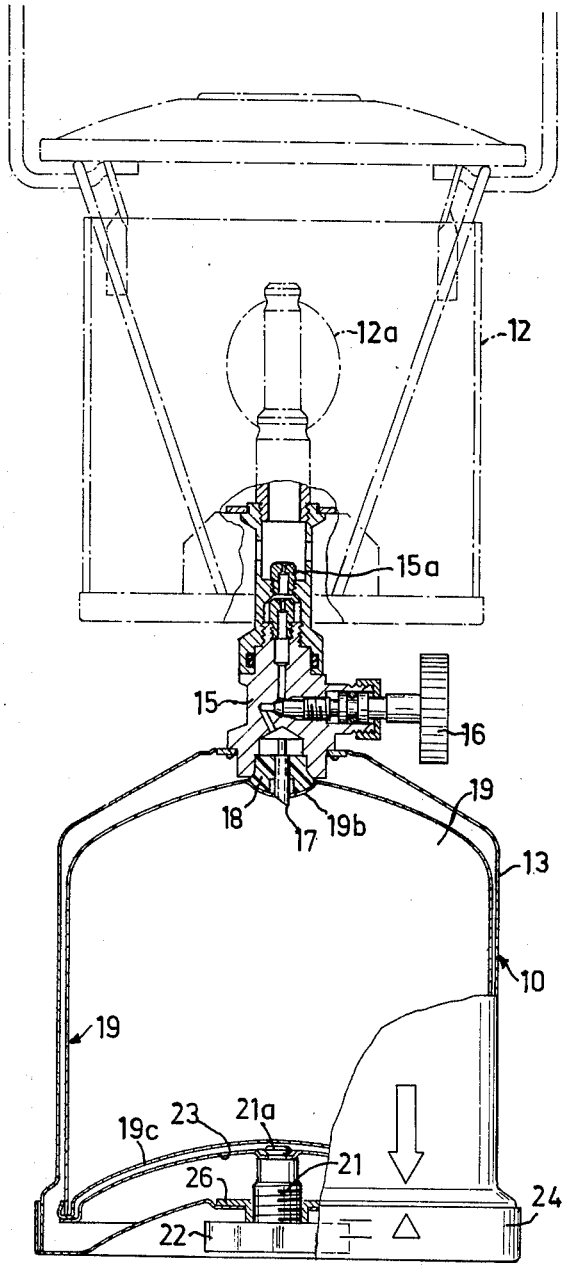
FIG. 2 is a side view of the lower portion in FIG. 1 provided with a screwed-on lamp with incandescent mantle.

In FIGS. 1 and 2 is shown a lower portion 10 for a camping stove, a burner 11 with cooking utensil support 11*a* being screwed on in FIG. 1, while a lamp 12 with an incandescent mantle 12*a* is screwed on in FIG. 2.

As may be seen from FIG. 3 the under portion housing 13 is made as a cylinder upwardly assuming the shape of a cone 14 with a central opening in which a valve unit 15 with jet 15*a* is inserted and fixed. The operating wheel 16 of the valve is not shown in FIG. 3, and neither are the puncturing means 17 and sealing means 18 which are shown in FIGS. 2 and 5.

From FIGS. 2 and 3 it will, however, be appreciated that the valve means 15 is not screwable but is fixed in the housing. This may be done in a known way, e.g. by riveting, and is so executed that the valve means will be rigidly united with the housing 13.

As may be seen from FIG. 5, the valve unit is provided with a puncturing means in the form of an auxiliary downwardly directed pipe 17, the lower end of which is obliquely cut to a point enabling penetration into the upper end of the gas container 19. The elastic seal 18 is disposed about the pipe 17, and in the free position assumes the position (FIG. 5) indicated by chain lines, and after compression due to the container 19 being pressed against the seal 18 on puncturing the position is assumed as shown in FIG. 5 by full lines.

When a burner is screwed off from the thread 15*b* on the valve unit, the under portion 10 can be held in a fast grip and the burner can be screwed away without risk that the valve unit 15 and its puncturing means 17 alter position axially in relation to the housing.

The gas container 19 is cylindrical and has a domed upper portion 19*a* which is shaped with a depression 19*b* in the middle, in which the seal 18 fits to center the container. The bottom portion 19*c* of the container is concave.

As is shown in FIG. 4, among others, the bottom portion of under portion 10 consists of a cover 20, and in the latter a screwably mounted screw 21 with wheel 22 and a spreader plate 23 rotatably mounted on the inner end of the screw 21, the plate 23 being dished to fit the the bottom 19*c* of the container for distributing contact pressure and centering the container 19. The screw is rotatable between a first position wherein the spreader plate 23 is in the dotted line position illustrated in FIG. 4 to a second position wherein the spreader plate 23 is in the solid line position shown in FIG. 4.

The cover 20 has a ring-shaped axial edge flange 24 which fits round the ring-shaped lower end 25 of the housing 13. In the middle of the cover 20 there is a bushing 26*a* or a corresponding portion with threads for the screw 21. The upper end of the screw 21 forms a journal 21*a* for the spreader plate 23, the journal 21*a* being upwardly enlarged or riveted over so that the spreader plate 23 is kept on the screw 21, but is rotatable.

Figure 1A:
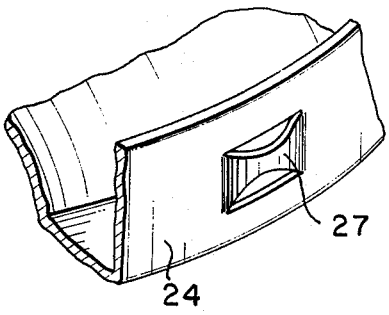
Figure 1B:
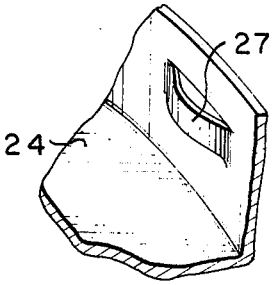

To form a bayonet coupling between the housing 13 and the cover 20 of the bottom portion, the lower ring-shaped end 25 of the housing 13 fits into the ring 24 of the cover 20 with a small clearance. On the housing ring 25 there is a groove 26, in three peripherally separated locations, of the shape shown in FIG. 3 and 3A. Coacting with this groove 26 there are three nodules 27 (FIGS. 1A, 1B and 6) pressed into the ring 24 of the cover so that these nodules form projections on the inside of the ring 24.

As best seen in FIGS. 3A and 6, each groove 26 in the bottom portion ring 25 has an axial ingress portion 28 adapted to receive a nodule 27 when the cover 20 is placed on housing ring 25. Thereafter the cover 20 is twisted so that the nodules 27 follow a peripheral groove portion 29 to an oblique stop 30 where the nodule is forced down into a peripheral groove portion 31 lying axially nearer to the end of the housing and which determines the final position of the nodule. The nodule 27 fits so exactly in this groove portion 31 that it has practically no axial movement, which means that the cover also has a fixed axial position relative to the housing.

Twisting the cover 20 backwards causes the nodule 27 to engage with a stop 32 lying in the extension of the grooved portion 31. To release the cover it must therefore be pressed in so upwardly that the nodule 27 can pass the stop 32 and come into the groove portion 29, via which it reaches the axial groove portion 28 which releases the nodule. When a gas container 19 is in position in lower portion 10, spreader plate 23 is in the position illustrated in FIG. 5 and cover 20 cannot be pushed in the axially upward direction. Accordingly, unintentional release of the cover 20 while a full container 20 is in position is prevented.

Introducing a new gas container 19 is done in such a way that it is inserted to assume a loosely lying position in the housing 13. Before putting on the bottom portion 20 which is shaped as a cover, the screw 21 is screwed backwards to the outer position shown in FIG. 8. The cover 20 is put onto the housing ring 25 and twisted fast into the position described above where the cover 20 has an axial, substantially fixed position on the end of the housing. In this position the wheel 22 of the screw will lie below the lower plane of the bottom portion, and if the lower portion 10 is placed on a substructure 33, as indicated by the chain line in FIG. 8, the lower portion 10 will be inclined, denoting that the screw 21 has not been tightened.

When the screw is then screwed in by turning the wheel 22 until it assumes the position shown in FIG. 5, the spreader plate 23 will be pressed against the bottom 19*c* of the container and will press the container against the puncturing means. The seal 18 is thereby compressed and the puncturing pipe 17 penetrates into the container for opening up the supply of gas.

Since the pressure from the screw is applied to the bottom 19*c* of the gas container by the intermediary of a spreader plate 23 which is rotatable relative to the screw 21, no tendency to turn the gas container 19 is caused, and the container is not turned when it is pressed against the puncturing means 17. Sinch the pressure on the latter is thus only axial, the load thereon is decreased during the puncturing process itself, especially when the puncturing means consists of an obliquely cut pipe. Needle-shaped puncturing means can, however, be used within the scope of the invention.

The bottom portion does not need to consist of a closed cover, but can also consist of a ring with one or more struts to carry the mounting for the screw 21. The spreader plate can also consist of a ring with spokes radiating from the mounting on the inner end 21*a* of the screw.

What I claim is:

1. A gas container housing for a camping stove, comprising:

a substantially cylindrical housing having a substantially closed upper part and an open lower part, said cylindrical housing adapted to enclose a gas container;

a valve unit rigidly attached to said upper part of said cylindrical housing and including an upwardly directed, threaded portion extending without said housing and an axially downwardly directed puncture means extending downwardly into said housing for puncturing an inserted expendable container;

a cover adapted to engage said open lower part of said housing such that when said housing and said cover are in operational engagement they form a substantially enclosed unit;

an axially extending screw threadably attached to said cover and having a first end extending into said substantially enclosed unit and a second end extending without said substantially enclosed unit;

a spreader plate rotatably connected to said first end of said screw and axially movable with said screw, said spreader plate being adapted to engage the underside of said container such that the container is centered relative to said housing by said spreader plate;

said axially extending screw being rotatable from a first position wherein said spreader plate supports said container a sufficient distance from said upper part of said housing such that said container is not engaged by said puncture means and a second position wherein said container is punctured by said puncture means;

coupling means for selectively coupling said cover to said housing to form a substantially enclosed chamber, said coupling means both retaining said cover on said housing when said valve unit punctures said container and preventing said cover from being removed from said housing when said container is positioned within said housing and said screw is in said second position.

2. A gas container housing as claimed in claim 1 wherein said selective coupling means comprises a bayonet coupling.

3. A gas container housing as claimed in claim 2 wherein said cover includes an axially extending flange portion adapted to engage said housing and wherein said bayonet coupling comprises:

a radially extending nodule in one of said lower portion of said housing or said flange portion;

a circumferential groove in the remaining one of said lower portion of said housing or said flange portion of said cover, said circumferential groove including a first and a second portion, said first portion being located closer to said upper part of said housing than said second portion, said first and second portions of said groove being connected by an intermediate portion whose lower surface includes a step therein;

an axially extending ingress groove extending from an edge of said remaining one of said lower portion of said housing or said flange portion of said cover to said first portion of said circumferential groove to permit said nodule to be inserted into said groove when said cover is placed in operational engagement with said housing; and said step in said lower surface of said intermediate portion of said groove extending a sufficient axial distance towards said upper portion of said housing that said nodule cannot pass from said second portion of said circumferential groove to said first portion to said circumferential groove while said screw is in said second position.

4. A gas container housing as claimed in claim 3 wherein said selectively coupling means includes a plurality of bayonet couplings.

5. A gas container housing as claimed in claim 1 wherein the axially lowermost edge of said cover lies along a plane which is substantially perpendicular to the axis of said housing and wherein said second end of said screw is provided with a knob which lies below the plane of said lowermost edge of said cover when said screw is in said first position and which lies above the plane of said lowermost edge of said cover when said screw is in said second position.

* * * * *